United States Patent [19]

Ippolito

[11] 4,040,142

[45] Aug. 9, 1977

[54] SAFETY DEVICE MORE PARTICULARLY FOR RABBET OF DOOR

[76] Inventor: Marceau Ippolito, Lot 55, Rue des Tiamas, Abidjan, Ivory Coast

[21] Appl. No.: 593,315

[22] Filed: July 7, 1975

[30] Foreign Application Priority Data

Aug. 13, 1974 France ..... 74.27992

[51] Int. Cl.[2] ..... E05D 11/00

[52] U.S. Cl. ..... 16/137; 16/148; 49/383

[58] Field of Search ..... 16/137, 148; 49/383, 49/486, 475

[56] References Cited

U.S. PATENT DOCUMENTS

| | | | |
|---|---|---|---|
| 465,708 | 12/1891 | Bishop | 16/137 |
| 474,633 | 5/1892 | Glazier | 49/383 |
| 613,592 | 11/1898 | Nagley | 49/383 |
| 1,444,398 | 2/1923 | Shepherd | 49/383 X |
| 1,626,844 | 5/1927 | Kuhn | 49/383 X |
| 2,641,792 | 6/1953 | Peeler | 16/137 |
| 2,694,234 | 11/1954 | Roby et al. | 49/383 |
| 3,581,884 | 6/1971 | Caldwell | 49/486 X |

*Primary Examiner*—Andrew V. Kundrat

[57] ABSTRACT

A safety device for covering the groove of an opening between doors, windows and the like, and its surrounding casing. The device comprises a bellows mounted opposite to the hinge axis whose opened out folds cover the groove when the door is open and which folds upon one another and to the door itself when the latter is closed.

6 Claims, 4 Drawing Figures

SAFETY DEVICE MORE PARTICULARLY FOR RABBET OF DOOR

BACKGROUND OF THE INVENTION

The technical field of the present invention is that of grooved safety devices for openings such as doors or windows.

Most doors or similar devices used for closing openings are mounted on hinge pins secured to a casing, which form the rotation axis, external of the thickness of the members themselves. Consequently, on the opposite side of members, on opening the leaf, a wide gap is exposed between edges facing the hinged leaf (i.e. door or window) and the casing.

The width of this gap increases the danger which it represents because it is easily accessible, particularly to the hands of children. This danger is completely eliminated by the present invention.

BRIEF SUMMARY OF THE INVENTION

The object of the present invention is to obviate dangers to which children and domestic animals are frequently exposed.

According to the present invention a bellows formed of a plurality of articulatingly connected relatively rigid panels whose opened out folds cover the groove when the door leaf is open, and whose closed folds come together one on another and to the door leaf itself when the latter is closed, whereby the appearance of this arrangement is made as unobtrusive as possible.

According to an embodiment of the invention, the panels of the bellows are joined on either side to plateband members which are respectively applied to the casing and leaf. These platebands can be self-adhesive with a covering which peels off.

To facilitate application, such bellows have their self-adhesive platebands in a jointed position, so adhesion takes place at an angle or flat with respect to each other on a leaf level with the face of the casing.

Between the two platebands the bellows has a short shutter member which, in the folded position is obscured beneath an longer shutter, whereby the whole arrangement is applied to the surface of the opening.

It is advantageous to supply such bellows in portions of different lengths which can be assembled to different heights at the junction between door leaf and casing opening, thus making it possible to cover a height less than the total height of the door, whereby the minimum height is limited to that necessary for providing the requisite protection.

BRIEF DESCRIPTION OF THE DRAWINGS

Other and further objects of the present invention will be apparent from the following description and claims and are illustrated in the accompanying drawings which by way of illustration show preferred embodiments of the present invention and the principles thereof and what are now considered to be the best modes contemplated for applying these principles.

In the drawings.

DETAILED DESCRIPTION OF THE PREFERRED EMBODIMENTS

Figure 1:
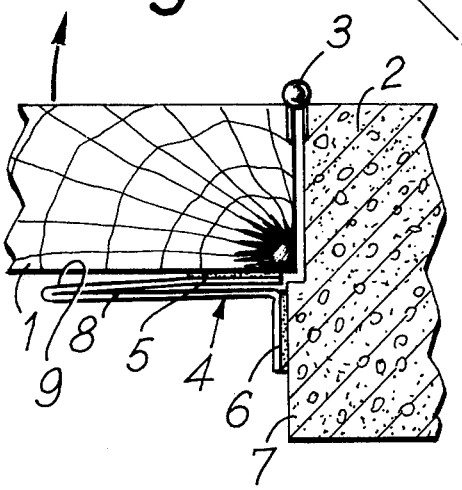
FIG. 1 is a section along a plane perpendicular to the pivot axis of the door leaf of a bellows in the obscured position with the door closed.
Figure 2:
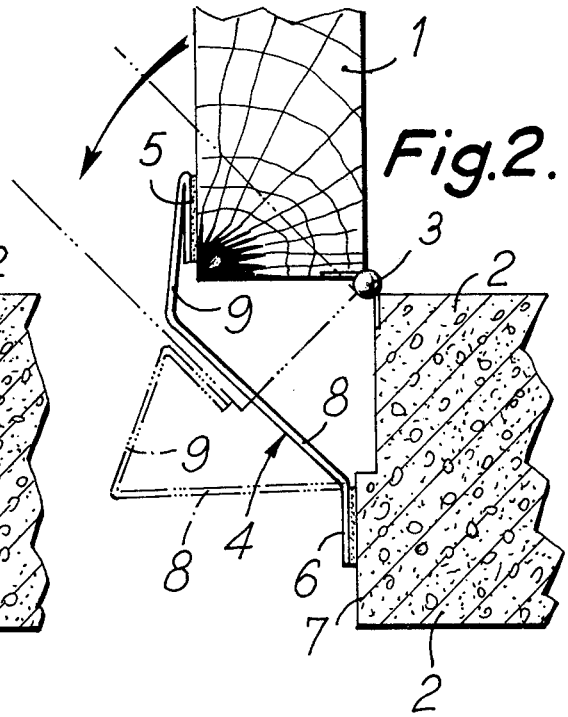
FIG. 2 is a similar view of the bellows with the door open.
Figure 4:
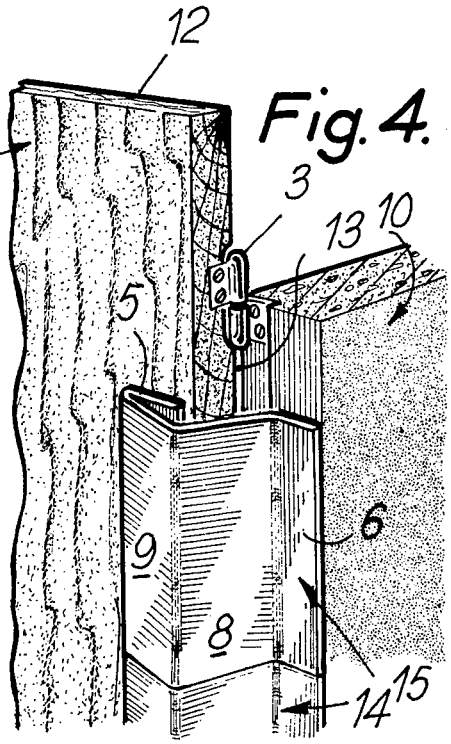
FIG. 4 is a perspective view, with the door open, showing the superimposition of several portions of a bellows.

In the example shown in FIGS. 1, 2 and 4 of the drawings, a door leaf 1 and the supporting casing 2, are joined together by means of door hinges 3. The gap between the door and casing on the face opposite the hinge is masked by a bellows 4 comprising four relatively rigid panels having one outer side member 5 forming a plateband secured by adhesion to the surface of frame 1 and another outer member side 6 also forming a plateband secured by adhesion to the inner surface 7 of the casing in a manner so that the two platebands are perpendicular to each other when it is closed on casing 2. Between the two platebands 5 and 6, the bellows 4 including a large shutter 8 and a narrower shutter 9 which are articulatingly connected together and in turn articulated on the edge of platebands 6 and 5 respectively. That is, as seen in FIG. 1, the bellows is folded first about an apical articulation between the inner shutters 8 and 9, forming a V shaped or angular disposition of the arms, and then about two folds between plateband 6 and shutter 8, and plateband 5 and shutter 9 respectively. In this disposition, the inside face of plateband 6 is secured to the casing surface 7 while the outside face of the plateband 5 is secured to the door 1. As a result, the bellows opens and closes in a variable triangular array with the base defined between the attachment points of the respective platebands 5 and 6 varying in length. In the open position the inner shutter 9 folds over contiguously with its associated plateband 5 on the door leaf while in the closed position the inner shutters 8 and 9 fold over each other and over the same plateband 5.

In this embodiment, the sum of the widths of the two shutters 8 and 9 must be slightly greater than the distance separating the attachment point on the casing from the attachment point on the door leaf, whilst the door is in the maximum opening position so that as seen in FIG. 2, the bellows completely covers the gap without interfering with the door movement. Moreover, the width of shutter 8 is virtually double that of shutter 9.

Thus, as can be seen in FIG. 1, on closing the door, bellows 4 discreetly folds on the door leaf to the minimum thickness of the superimposition of shutters 8 and 9.

Figure 3:
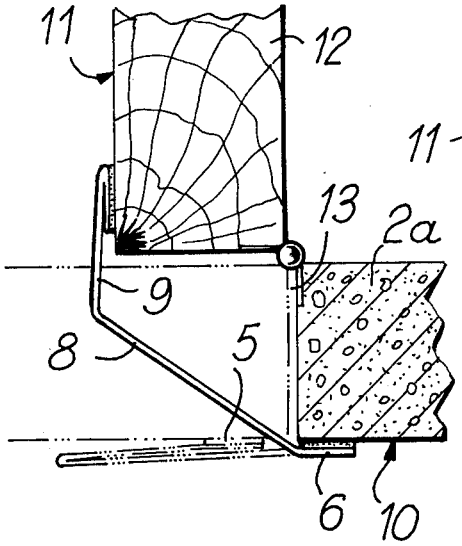
FIG. 3 is a view of the bellows on a door leaf flush with the surface of a casing.

As seen in FIG. 3, the device shown can also be applied to a flush hinge door by seaming the plateband 6 to the outer face 10 of a casing 2*a*, and the plateband 5 to the corresponding face 11 of a door 12, when the door is in the closed position. In such a case, the two platebands 5 and 6 are aligned in substantially the same plane and positioned astride the groove gap 13 with the bellows closed.

To ensure a good application, platebands 5 and 6 on which are articulated shutters 8 and 9 of bellows 4 can be provided with a self-adhesive material protected by a covering which can be peeled off at the time of application. However, other assembly methods are also possible such as nailing, hooking, screwing or the like. The present device protects the hands or limbs of users on the dangerous side of the hinge of openings as well as ensuring the sealing thereof.

When used as a safety device relative to young children or domestic animals, it is sufficient for a bellows of this type to be installed over a limited height, representing a fraction of the door height. For this reason, it is advantageous to produce the bellows in portions of various lengths, such as seen by the portions 14 and 15 in FIG. 4 which are superimposed with the desired type and number over the height of the door to be covered and not necessarily full to its upper edge 12.

Thus, solid and reliable protective means are provided which is completely effective in a very economic manner using cheap materials such as artificial plastics, grooved cardboard and analogous substances with or without a decorative covering. The bellows can even be formed in a manner imitating the materials used for the casings and doors. The relative rigidity of the materials used prevents an deformation towards the gap to be protected.

While there has been described and illustrated the preferred embodiments of the invention, it is to be understood that these are capable of variation and modification and it is therefore not desired to be limited to the precise details set forth, but to include such modifications and alterations as fall within the scope of the appended claims.

What is claimed is:

1. In combination with a door or the like, mounted by a hinge to a supporting casing, a safety device for covering the gap between the door and casing, comprising a bellows having four parallel panels, the opposing outer panels of which being attached respectively, to the door and the casing on the side opposite the hinge, inner panels of which being articulatingly connected therewith and with each other in a manner so that when the door is closed said panels automatically fold over each other and flat over the door itself, the inner panel associated with the outer side panel attached to said door being narrower in width than the other inner panel, and said other inner panel folds over said smaller panel when said door is closed.

2. The bellows according to claim 1, wherein said panels are arranged so that the inner panel associated with the outer panel secured to said door folds over contiguous therewith when said door is opened.

3. The bellows according to claim 1, wherein the outer side panel secured to said door is attached on a surface opposite relatively to that surface by which the other outer side panel is secured to the casing.

4. The bellows according to claim 1, with the sum of the inner panels being slightly greater than the distance separating the outer side panels when attached respectively to the door and casing.

5. The bellows according to claim 1, wherein said other inner panel is approximately twice the width of the smaller inner panel.

6. The combination according to claim 1, including a plurality of bellows arranged longitudinally along a selected portion of the length of said door and casing.

* * * * *